United States Patent [19]

Rammos

[11] Patent Number: 4,626,865

[45] Date of Patent: Dec. 2, 1986

[54] ANTENNA ELEMENT FOR ORTHOGONALLY-POLARIZED HIGH FREQUENCY SIGNALS

[75] Inventor: Emmanuel Rammos, Creteil, France

[73] Assignee: U.S. Philips Corporation, New York, N.Y.

[21] Appl. No.: 548,263

[22] Filed: Nov. 3, 1983

[30] Foreign Application Priority Data

Nov. 8, 1982 [FR] France ..... 82 18700
Apr. 29, 1983 [FR] France ..... 83 07109

[51] Int. Cl.[4] ..... H01Q 13/02
[52] U.S. Cl. ..... 343/786
[58] Field of Search ..... 343/700 MS, 778, 786, 343/797

[56] References Cited

U.S. PATENT DOCUMENTS 3,665,480 1/1969 Fassett ..... 343/700 MS

*Primary Examiner*—Eli Lieberman

*Attorney, Agent, or Firm*—Robert J. Kraus

[57] ABSTRACT

A radiating or receiving element for orthogonally polarized high-frequency signals comprises, on both sides of a first layer having a first cavity, first and second perpendicular high-frequency transmission lines and at the other side of the transmission lines a second layer having a second cavity and a third layer having a third cavity facing the other two cavities but short-circuited so as to form a reflecting plane, the transmission lines being constituted by symmetrical slots and conducting strips, which are provided in the median plane of these lines and whose ends project into the cavities to form exciting probes whose lengths are different and chosen such that for any predetermined thickness of the first layer, the pairs of values: lengths of the end of a probe/-distance of the probe to the sole reflecting plane correspond to an experimentally maximum or nearly maximum coupling between each of the probes and the propagation medium.

6 Claims, 3 Drawing Figures

ANTENNA ELEMENT FOR ORTHOGONALLY-POLARIZED HIGH FREQUENCY SIGNALS

BACKGROUND OF THE INVENTION

The present invention relates to a receiving element for orthogonally polarized high-frequency signals or, in accordance with the reciprocity principle of antennae, a radiation element for such signals realized in a similar way, this element comprising a dielectric layer on both sides of a first high-frequency transmission line whose end forms an exciting probe.

The invention also relates to a planar antenna comprising an array of juxtaposed elements of this type, and is particularly used in the field of receiving 12 GHz television signals transmitted by satellites. Obviously, in view of the reciprocity principle of an antenna, a receiving element (or an antenna constituted by an array of receiving elements) is capable of functioning as a radiating element (radiating antenna) without any modifications of its characteristics. This remark holds without any exception throughout the following description, and the word receiving, receive, receiver can at all times be replaced by the words transmission, transmit, radiating.

A planar antenna comprising such elements is described in the article "New wideband high-gain stripline planar array for 12 GHz satellite TV" by E. Rammos, published in the periodical Electronics Letters, Volume 18, No. 6, Mar. 18, 1982, pages 252 and 253. In spite of an encouraging performance, this antenna has not proved to be completely satisfactory as regards its efficiency.

SUMMARY OF THE INVENTION

The invention has for its object to provide a receiving element and an antenna (constituted by an array of such elements) in which the efficiency is improved.

The invention therefore relates to a receiving or a radiating element as defined in the preamble, and is characterized in that it also comprises a second transmission line and a third dielectric layer arranged such that the element has, respectively, on both sides of the first layer in which a first cavity is provided, the first and second high-frequency transmission lines arranged according to two perpendicular axes, and also has on the other side of one of the transmission lines, the second layer which has a second cavity facing the first one, and, on the other side of the other transmission line, the third layer which has a third cavity facing the two other cavities but being short-circuited at a distance from this other transmission line less than the thickness of this third layer so as to form a reflecting plane. The first and second transmission lines are formed on the one hand by slots provided symmetrically in adjacent layers and on the other hand by conducting strips. The conducting strips are provided in the median planes of the respective transmission lines and have ends which penetrate along the axes into the cavities to form exciting probes. The probes effect, with the propagation medium, a coupling which enables the reception or the radiation of the high-frequency signals. The lengths of these ends forming the exciting probes are different and chosen such that, for any predetermined thickness of the first layer, the lengths of the ends of the probes and the distances from the probes to the reflecting plane correspond to an experimentally maximum or nearly maximum coupling between each of the probes and the propagation medium contained in the cavities.

In the structure thus proposed, the use of suspended-substrate transmission lines and the possibility to realize a matching of the exciting probes by a different choice of their lengths according to the distance between these probes, predominantly caused by the fact that suspended-substrate transmission lines are used, contributes to a very significant increase in the radiating characteristics. On the other hand, this structure enables a very simple mechanical implementation while allowing a rather wide spacing between the planes in which the two exciting probes are located. This simplifies provision of the layers with slots which together with the conductors form the transmission lines. This guiding in air then permits the use of a dielectric of an ordinary quality as regards its high-frequency properties, without its losses becoming too high.

The invention also relates to a high-frequency planar antenna assembled from a whole array of such elements and having similar characteristics.

BRIEF DESCRIPTION OF THE DRAWING

Particulars and advantages of the element and the antenna will now be described in greater detail by way of non-limitative example with reference to the accompaying drawing, in which.

DESCRIPTION OF THE PREFERRED EMBODIMENT

Figure 1:
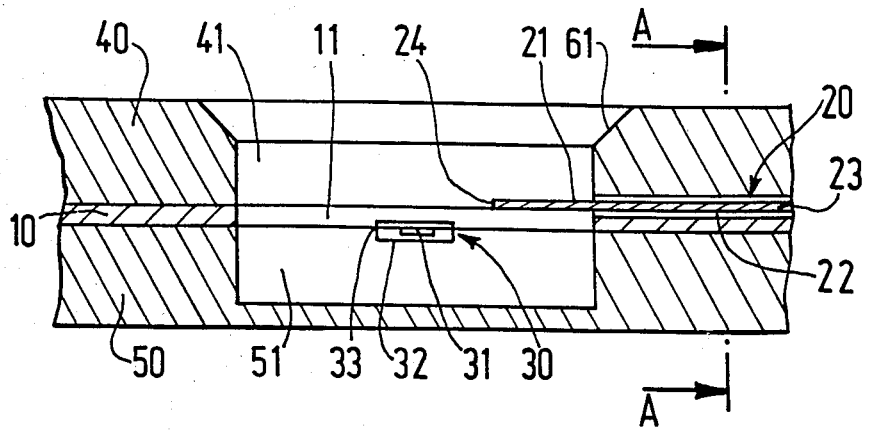
FIG. 1 shows an embodiment of the receiving element according to the invention.

Referring to the drawing, on both sides of a first layer 10, in which a first cavity 11 (in this example a circular cavity) with metal-plated inner surface is made, there are provided a first transmission line 20 and a second transmission line 30 constituted by conducting strips 21 and 31 arranged in the median plane of slots 22 and 32 and by thin dielectric sheets 23 and 33 supporting the conductors. The ends of the central conductors of these high-frequency suspended-strip transmission lines denoted by 24 and 34 project along two perpendicular axes into the interior of the cavities, thus constituting two exciting probes which realize, with the propagation medium, a coupling which enables the reception of high-frequency signals; these two ends penetrate into the cavity by different lengths, as described above. The other end of each line forms its output, when it is used for reception.

On the other side of the line 20, a second layer 40 is provided which also has a second cavity 41 with metal-plated inner surface and facing the first cavity 11, and, similarly, on the other side of the line 30, a third layer 50 is provided which has a third cavity 51 with metal-plated inner surface and facing the two other cavities. This cavity 51 is short-circuited in a plane parallel to the surfaces of the layers, at a distance from the line 30 which is distinctly less than the width of the layer 50, so as to form a sole reflecting plane for the received high-frequency signals. The element thus described behaves as a waveguide-to-suspended substrate line transition, in which the axis of the waveguide is perpendicular to the plane of the lines.

The first, second and third layers 10, 40 and 50 may be metal-plated, or may be in the form of a dielectric material with metal-plated walls of the cavities 11, 41 and 51 penetrating through this respective layers. On the other hand, the diameter of the cavities must be sufficiently small, relative to the wavelength associated with the frequency of the high-frequency signals, to prevent the appearance of or to attenuate the propagation of unwanted higher modes and must be sufficiently large to enable the propagation of the main mode in the passband under consideration. Finally, the cavity 41 ends in a truncated cone shaped widening 61, possibly covered with a polyurethane screen, these arrangements contributing to an increase in the gain and to an improvement of the radiation characteristics.

Figure 2:
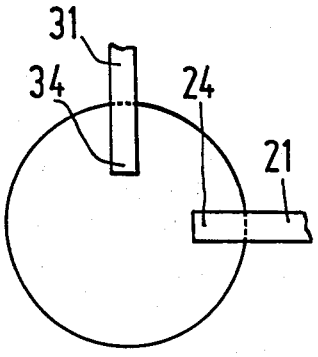
FIG. 2 shows an arrangement of the exciting probes by means of which it is possible to obtain a high gain for the receiving element.

The trials made with a receiving element having the above-described structure have led to the study of the influences, in the results obtained, of the length of the ends of the lines 20 and 30 located effectively opposite the aligned cavities 11, 41, 51. These experimental measurements, which mainly concern the coupling between these ends of the lines 20 and 30 and the propagation medium, that is to say the cavity constituted by the assembly of the aligned cavities, have resulted in an optimization of this coupling when the said two ends, or exciting probes, have different lengths. Put more accurately for a predetermined length of one of the exciting probes, a search was made to find that distance of this probe to the sole reflecting plane (formed by the bottom of the layer 50) which accomplishes a satisfactory and if possible maximum matching in the frequency band concerned (here substantially the frequencies from 11.7 to 12.5 GHz); FIG. 2 shows an example of the arrangement of the two probes of different lengths.

It is thus possible to provide Tables indicating the correspondence between the probe lengths and the distance to the reflector which give the best possible matches. The distance between the probes being thereafter fixed by the thickness of the layer 10 (chosen according to the imposed electromechanical necessities: the mechanical realization of the layer, putting slots of the transmission lines 20 and 30 in the layers 10 and 40 and also in the layers 10 and 50, . . . ) one searches in such Tables of correspondence for two values of the length for which the associated values of the distance to the sole reflecting plane differ from one another by this value of the thickness of the layer 10.

Within the frame work of the trials made with square receiving elements with rounded tops, it has been possible to obtain at the end of the transmission line, the extremity of whose central conductor constitutes the exciting probe, a standing wave ratio less than 1.6 (which corresponds to transmission losses less than 0.25 dB) in the following circumstances:

the side of the square is equal to 0.31 λg, that is to say in the present case 15 millimeters (the wavelength λg being the wavelength in the guide portion of the receiving element) and a radius of curvature of the rounded tops equal to 3 millimeters;

the distance between the probe of the line 20 to the reflecting plane is 0.27 λg;

the distance between probe of the line 30 to the reflecting plane is 0.17 λg;

the length of the probe end of the line 20 projecting into the cavity is 0.12 λg;

the length of the probe end of the line 30 projecting into the cavity is 0.10 λg;

the vertical distance between these two probes is 0.10 λg (that is to say, at 12 GHz, 5 millimeters, which is sufficient for making, by machining, the slots of the transmission lines 20 and 30).

These values which, as described above, correspond to the example of square elements with rounded tops, hold for a line impedance of approximately 70 ohms, the widths of the central conductors being 1.4 millimeters, in slots of 2.5×1.8 millimeters.

Figure 3:
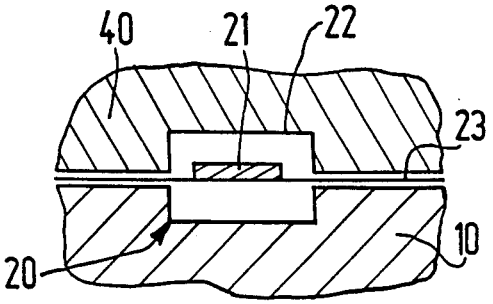
FIG. 3 is a partially cross-sectional view along the axes AA of FIG. 1 and shows the arrangement of the transmission lines on a suspended substrate.

To position the lines 20 and 30 between the layers 10 and 40 on the one hand and 10 and 50 on the other hand, it should be noted that the above-mentioned slots, which generally have a rectangular shape, are known, for example, from FIG. 4 of the U.S. Pat. No. 3,587,110 issued on June 22, 1971, and assigned to RCA Corporation, the principle of said Figure being shown in FIG. 3 of the present application (reference may also be had to the article "Careful MIC design prevents waveguide modes", published in the periodical Microwaves, May 1977, page 188 ff., FIG. 1). It is also apparent that at the output of these lines 20 and 30, there may be provided, to allow the reconstitution of signals with right-handed circular polarization and with left-handed circular polarization, a hybrid 3 dB coupler whose two inputs are connected to the respective outputs of the lines 20 and 30 and whose two outputs supply the said signals with right-handed or left-handed circular polarization. It is also possible to place, instead of the coupler, a depolarizing structure before the receiving element. Finally, using neither a coupler nor a depolarizing structure, signals are obtained which have two perpendicular linear polarizations.

Obviously, the present invention is not limited to the receiving, or radiating, element described in the foregoing, from which variations may be proposed without departing from the scope of the invention. Particularly, the invention also relates to a high-frequency planar antenna constituted by a whole array of such receiving elements, a further condition being added to the above-mentioned conditions regarding the diameter of the cavities that, for a satisfactory side-by-side positioning of the elements, this diameter must be sufficiently small (relative to the wavelength in the cavity associated with the frequency of the high-frequency signals), so that the distance between these elements may be less than the said wavelength. Only this last condition actually prevents the appearance of unwanted side lobes, known as array lobes.

The structure of this radiating or receiving antenna is in all respects similar to that of the radiating or receiving element, and everything written above with respect to the elements may be transferred to the antenna, the transmission lines excepted. The antenna comprises indeed not only two transmission lines leading from the receiving element to two output connections but, more precisely, two arrays of high-frequency transmission lines which are electrically independent, as are the lines 20 and 30, and intended, similar to these lines 20 and 30, to ensure the transmission of received high-frequency signals to the electronic circuits exterior of the antenna. In this case a hybrid 3 dB coupler can now be arranged at the output of these two arrays (or, instead of the coupler, a depolarizing structure preceding the antenna assembly) for reconstituting signals with right-handed or left-handed circular polarization.

These arrays are each formed, in a way well-known from numerous embodiments (see more specifically the structure of the array shown in FIG. 1 of the French Patent Specification No. 7011449) corresponding to U.S. Pat. No. 3,587,110, by a succession of combining stages. If the antenna comprises n receiving elements, the n first ends of each array serve, as described already for a single receiving element, for coupling to the propagation space of the signals to be received, while the single opposite end of each of the two arrays, i.e. the point in which all the transmission lines converge via the consecutive combining stages, is connected to the electronic receiving circuits outside the antenna (and, for example, first of all to both the two inputs of the 3 dB coupler which enables the reconstitution of the signals with right-handed and left-handed circular polarization).

An antenna realized thus is particularly suitable for a low-cost modular construction, in which the elementary blocks forming sub-assemblies of receiving elements can be used in adequate numbers and joined assembling to form antennas with well-determined dimensions, gains and directional diagrams, such as, for example, a symmetrical antenna of a square shape, or in a more general way asymmetrical antennae, more specifically of a rectangular shape, which have different radiation diagrams in two orthogonal planes. This last characteristic is particular interesting for antennae receiving 12 GHz television signals transmitted by satellite, since an opening at 3 dB less than 2° is in this case only necessary in the equatorial plane to separate the signals from two "remote" satellites, in this plane, by 3° (see the C.C.I.R. recommendations, Geneva, 1977).

A further embodiment of the modular type can also be proposed with advantage: if one wants to have the disposal of a planar antenna which must not receive or transmit high-frequency signals other than signals of one type of polarization (linear, or circular while maintaining a depolarizing structure), the said antenna can be obtained from the antenna described in the foregoing by simply omitting the central layer 10 and one of the two supply arrays 20 or 30.

Finally, it is obvious that applying the invention to the reception of 12 GHz television signals transmitted by satellite is not the only possible application, although the described antenna is indeed intended mainly for coupling to one or several receiving front ends for such signals (an example of these receiving front ends is described more specifically in the periodical "L'Onde Electrique", Volume 62, No. 3, March 1982, pages 39 and 40). The invention can be applied to all types of purely ground-based high-frequency transmission arrays, and on the other hand the choice of an example of applying it to the 12 GHz frequency does not exclude the possibility to apply it to any other frequency in the high-frequency range, connected with the intended use.

What is claimed is:

1. A high-frequency antenna comprising a first dielectric layer having a hole extending therethrough defining a first cavity, second and third dielectric layers on opposite sides of said first layer, said second layer having a hole therethrough aligned with said first cavity and defining a second cavity, said third layer having a planar closed bottom recess facing and aligned with said first cavity and defining a third cavity, the sides of said holes and recess and the bottom of said recess having a conductive coating, a first groove between said first and second layers extending to said cavities, a second groove between said first and third layers extending to said cavities in a direction perpendicular to said first groove, and first and second conductors disposed in said first and second grooves, respectively, extending different distances into said cavities, and defining first and second transmission lines with said first and second grooves, respectively, portions of the conductors extending into the cavities comprising probes for the reception or radiation of high-frequency signals.

2. An antenna element as in claim 1 including first and second thin dielectric sheets disposed between said first and second layers and between said first and third layers, respectively, said dielectric sheets extending through said cavities, said first and second conductors comprising conductive strips supported in said cavities on said first and second dielectric sheets, respectively.

3. An antenna element for orthogonally-polarized high-frequency signals, said antenna element comprising:

(a) first, second and third dielectric layers having respective first, second and third cavities defined by side walls of the respective layers, said first layer being disposed between said second and third layers such that the first, second and third cavities cooperate to form a common cavity, said third cavity terminating in a short circuit formed by a conductively-coated end wall perpendicular to said side wall thereof;

(b) a first transmission line comprising a first slot formed in at least one of facing sides of the first and second dielectric layers and a first conductor disposed in said first slot, said first slot communicating with the common cavity and said first conductor extending into said common cavity; and (c) a second transmission line comprising a second slot formed in at least one of facing sides of the first and third dielectric layers and a second conductor disposed in said second slot, said second slot communicating with the common cavity and said second conductor extending into said common cavity perpendicularly to the first conductor;

the first and second conductors extending by differing lengths into the common cavity, said lengths and the distances from said conductors to the end wall being chosen to maximize coupling between the transmission lines and the common cavity.

4. An antenna element as in claim 3 including first and second thin dielectric sheets disposed between the first and second layers and between the first and third layers, respectively, said dielectric sheets extending through said common cavity, said first and second conductors comprising conductive strips supported in the common cavity on said first and second dielectric sheets, respectively.

5. An antenna as claimed in claims 3 or 4 wherein the first, second and third layers are made from a dielectric material, with metal-plated walls of the cavities extending through them.

6. An antenna as claimed in claims 3 or 4 wherein the first, second and third layers are metal-plated.

* * * * *